US011211015B2

(12) United States Patent
Yin

(10) Patent No.: US 11,211,015 B2
(45) Date of Patent: Dec. 28, 2021

(54) PIXEL DATA COMPENSATION METHOD AND DEVICE FOR DISPLAY DEVICE, DISPLAY DEVICE

(71) Applicant: BOE TECHNOLOGY GROUP CO., LTD., Beijing (CN)

(72) Inventor: Xinshe Yin, Beijing (CN)

(73) Assignee: BOE TECHNOLOGY GROUP CO., LTD., Beijing (CN)

( * ) Notice: Subject to any disclaimer, the term of this patent is extended or adjusted under 35 U.S.C. 154(b) by 363 days.

(21) Appl. No.: 16/472,013

(22) PCT Filed: Nov. 2, 2018

(86) PCT No.: PCT/CN2018/113747
§ 371 (c)(1),
(2) Date: Jun. 20, 2019

(87) PCT Pub. No.: WO2019/200893
PCT Pub. Date: Oct. 24, 2019

(65) Prior Publication Data

US 2021/0343246 A1 Nov. 4, 2021

(30) Foreign Application Priority Data

Apr. 18, 2018 (CN) ..... 201810351164.7

(51) Int. Cl.
*G09G 3/3291* (2016.01)

(52) U.S. Cl.
CPC ..... *G09G 3/3291* (2013.01); *G09G 2310/027* (2013.01)

(58) Field of Classification Search
CPC ..... G09G 3/3291; G09G 2310/027
See application file for complete search history.

(56) References Cited

U.S. PATENT DOCUMENTS

2007/0263017 A1* 11/2007 Umeda ..... G09G 3/3688 345/691
2010/0302266 A1* 12/2010 Morita ..... G09G 3/3688 345/559

(Continued)

FOREIGN PATENT DOCUMENTS

CN 104318900 A 1/2015
CN 105513536 A 4/2016

(Continued)

OTHER PUBLICATIONS

International Search Report of PCT/CN2018/113747 in Chinese, dated Feb. 2, 2019, with English translation.

(Continued)

*Primary Examiner* — Andrew Sasinowski
(74) *Attorney, Agent, or Firm* — Collard & Roe, P.C.

(57) ABSTRACT

A pixel data compensation method and device for a display device, and a display device are disclosed. The pixel data compensation method includes: obtaining, for a sub-pixel of an n-th row in a column, a pixel compensation quantity Q of the sub-pixel according to a row compensation coefficient $K_n$ of the n-th row of sub-pixels and a voltage deviation $\Delta V_{data}$ corresponding to an initial pixel data $V_{data}$ of the sub-pixel; compensating the initial pixel data $V_{data}$ of the sub-pixel according to the pixel compensation quantity Q of the sub-pixel to obtain a compensated pixel data $V'_{data}$ of the sub-pixel, and the row compensation coefficient $K_n$ decreases as a row number of the row in which the sub-pixel is located increases.

20 Claims, 8 Drawing Sheets

(56) References Cited

U.S. PATENT DOCUMENTS

| | | | | |
|---|---|---|---|---|
| 2014/0118410 | A1 | 5/2014 | Oh | |
| 2015/0332638 | A1* | 11/2015 | Li | G09G 3/3655 345/214 |
| 2016/0078813 | A1* | 3/2016 | Mizukoshi | G09G 3/3291 345/76 |
| 2017/0352314 | A1* | 12/2017 | Matsui | G09G 3/3258 |
| 2018/0005600 | A1* | 1/2018 | Ikeda | G02F 1/133603 |
| 2018/0061312 | A1 | 3/2018 | He et al. | |
| 2018/0182288 | A1* | 6/2018 | Kim | G09G 3/3225 |
| 2018/0268753 | A1 | 9/2018 | Wang et al. | |

FOREIGN PATENT DOCUMENTS

| | | | |
|---|---|---|---|
| CN | 106652966 | A | 5/2017 |
| CN | 106782319 | A | 5/2017 |
| CN | 108520718 | A | 9/2018 |

OTHER PUBLICATIONS

Notice of Transmittal of the International Search Report of PCT/CN2018/113747 in Chinese, dated Feb. 2, 2019.

Written Opinion of the International Searching Authority of PCT/CN2018/113747 in Chinese, dated Feb. 2, 2019 with English translation.

* cited by examiner

PIXEL DATA COMPENSATION METHOD AND DEVICE FOR DISPLAY DEVICE, DISPLAY DEVICE

CROSS-REFERENCE TO RELATED APPLICATIONS

This application is the National Stage of PCT/CN2018/113747 filed on Nov. 2, 2018, which claims priority under 35 U.S.C. § 119 of Chinese Application No. 201810351164.7 filed on Apr. 18, 2018, the disclosure of which is incorporated by reference.

TECHNICAL FIELD

The embodiments of the present disclosure relate to a pixel data compensation method and device for a display device, and a display device.

BACKGROUND

Organic Light Emitting Diode (OLED) displays have been widely used in in various electronic apparatus including electronic products such as computers and mobile phones because of their advantages of self-illumination, light weight, low power consumption, high contrast, high color gamut, flexible display and so on.

Pixel circuits in an OLED display device generally adopt a matrix drive method, and are divided into an active matrix (AM) drive mode and a passive matrix (PM) drive mode according to whether or not a switch component is introduced in each pixel circuit. Although PMOLED has simple process and low cost, it cannot meet the requirements of high-resolution, large-size display due to the shortcomings such as crosstalk, high power consumption and low lifetime. In contrast, AMOLED integrates a set of thin film transistors and a storage capacitor(s) in the pixel circuit of each pixel. By controlling the drive of the thin film transistors and the storage capacitor(s), the current flowing through an OLED is controlled, so that the OLED is made to emit light as needed. Compared with PMOLED, AMOLED requires less drive current, lower power consumption and longer lifetime, which can meet the needs of large-size display with high resolution and multiple gray scales. At the same time, AMOLED has obvious advantages in terms of viewing angle, color restoration, power consumption and response time, and is suitable for display devices for high information content and with high resolution.

SUMMARY

At least one embodiment of the present disclosure provides a pixel data compensation method of a display device, the display device including N rows of sub-pixels, the pixel data compensation method including: obtaining, for a sub-pixel of an n-th row in a column, a pixel compensation quantity Q of the sub-pixel according to a row compensation coefficient $K_n$ of the n-th row of sub-pixels and a voltage deviation $\Delta V_{data}$ corresponding to an initial pixel data $V_{data}$ of the sub-pixel; and compensating the initial pixel data $V_{data}$ of the sub-pixel according to the pixel compensation quantity Q of the sub-pixel to obtain a compensated pixel data $V'_{data}$ of the sub-pixel, wherein the row compensation coefficient $K_n$ decreases as a row number of the row in which the sub-pixel is located increases, and $0 \le K_n \le 1$, $1 \le n \le N$, and $1 \le N$.

For example, in a pixel data compensation method provided by an embodiment of the present disclosure, the voltage deviation $\Delta V_{data}$ corresponding to the initial pixel data $V_{data}$ of the sub-pixel is a voltage difference between a voltage of a gate electrode of a driving transistor of a sub-pixel of a first row and a voltage of a gate electrode of a driving transistor of a sub-pixel of a last row in a case where each row of sub-pixels is driven row by row using same initial pixel data $V_{data}$.

For example, in a pixel data compensation method provided by an embodiment of the present disclosure, the row compensation coefficient of the n-th row of sub-pixels is:

$$K_n = \frac{N-n}{N-1} \text{ or } K_n = \frac{N-n}{N}.$$

For example, in a pixel data compensation method provided by an embodiment of the present disclosure, the voltage deviation $\Delta V_{data}$ corresponding to the initial pixel data $V_{data}$ of the sub-pixel and the initial pixel data $V_{data}$ of the sub-pixel satisfy a first relation: $\Delta V_{data}=\alpha(V_{data}-V_{ref})$ wherein $\alpha$, $\beta$ are compensation coefficients and are constants for the display device; and $V_{ref}$ is a charging reference voltage of a storage capacitor for compensating a threshold voltage of the driving transistor in the sub-pixel.

For example, in a pixel data compensation method provided by an embodiment of the present disclosure, the pixel compensation quantity Q of the sub-pixel, the row compensation coefficient $K_n$ of the n-th row of sub-pixels and the voltage deviation $\Delta V_{data}$ corresponding to the initial pixel data $V_{data}$ of the sub-pixel satisfy a second relation: $Q=K_n \cdot \Delta V_{data}$.

For example, in a pixel data compensation method provided by an embodiment of the present disclosure, the compensated pixel data $V'_{data}$ of the sub-pixel, the initial pixel data $V_{data}$ of the sub-pixel and the pixel compensation quantity Q of the sub-pixel satisfy a third relation: $V'_{data}=V_{data}-Q$.

For example, in a pixel data compensation method provided by an embodiment of the present disclosure, the display device further includes a digital-to-analog converter and a buffer, an input display data is converted by the digital-to-analog converter and a converted input display data is amplified by the buffer to obtain the initial pixel data $V_{data}$.

At least one embodiment of the present disclosure also provides a pixel data compensation device of a display device, the display device including N rows of sub-pixels, the pixel data compensation device including: a pixel compensation quantity operation circuit, which is configured to obtain, for a sub-pixel of an n-th row in a column, a pixel compensation quantity Q of the sub-pixel according to a row compensation coefficient $K_n$ of the n-th row of sub-pixels and a voltage deviation $\Delta V_{data}$ corresponding to an initial pixel data $V_{data}$ of the sub-pixel; and a compensation pixel data operation circuit, which is configured to compensate the initial pixel data $V_{data}$ of the sub-pixel according to the pixel compensation quantity Q of the sub-pixel to obtain a compensated pixel data $V'_{data}$ of the sub-pixel, wherein the row compensation coefficient $K_n$ decreases as a row number of the row in which the sub-pixel is located increases, and $0 \le K_n \le 1$, $1 \le n \le N$, and $1 \le N$.

For example, in a pixel data compensation device provided by an embodiment of the present disclosure, the voltage deviation $\Delta V_{data}$ corresponding to the initial pixel data $V_{data}$ of the sub-pixel is a voltage difference between a voltage of a gate electrode of a driving transistor of a sub-pixel of a first row and a voltage of a gate electrode of a driving transistor of a sub-pixel of a last row in the case where each row of sub-pixels is driven row by row using same initial pixel data $V_{data}$.

For example, in a pixel data compensation device provided by an embodiment of the present disclosure, the pixel compensation quantity operation circuit includes: a first sub-operation circuit, a second sub-operation circuit and a third sub-operation circuit, wherein a first input terminal of the first sub-operation circuit is coupled to a reference voltage terminal to receive the reference voltage $V_{ref}$, a second input terminal of the first sub-operation circuit is coupled to an initial pixel data input terminal to receive the initial pixel data $V_{data}$, an output terminal of the first sub-operation circuit is coupled to a first input terminal of the second sub-operation circuit; a second input terminal of the second sub-operation circuit is coupled to a first voltage terminal to receive a first voltage, and an output terminal of the second sub-operation circuit is coupled to a first input terminal of the third sub-operation circuit; and an output terminal of the third sub-operation circuit is coupled to the compensation pixel data operation circuit, and the third sub-operation circuit is configured to invert the obtained pixel compensation quantity of the sub-pixel and output an inverted pixel compensation quantity to the compensation pixel data operation circuit.

For example, in a pixel data compensation device provided by an embodiment of the present disclosure, a voltage gain of the first sub-operation circuit is equal to $\alpha$; a first voltage of the first voltage terminal is $\beta$, a voltage gain of the second sub-operation circuit is equal to 1; a voltage gain of the third sub-operation circuit is equal to the row compensation coefficient $K_n$.

For example, in a pixel data compensation device provided by an embodiment of the present disclosure, the compensation pixel data operation circuit includes a fourth sub-operation circuit and a fifth sub-operation circuit; a first input terminal of the fourth sub-operation circuit is coupled to a output terminal of the third sub-operation circuit to receive the inverted pixel compensation quantity of the sub-pixel, a second input terminal of the fourth sub-operation circuit is coupled to the initial pixel data input terminal for the sub-pixel to receive the initial pixel data, and an output terminal of the fourth sub-operation circuit is coupled to an input terminal of the fifth sub-operation circuit and is configured to obtain the compensated pixel data $V'_{data}$ of the sub-pixel after inverting by the fifth sub-operation circuit.

For example, in a pixel data compensation device provided by an embodiment of the present disclosure, the first sub-operation circuit includes a first difference circuit, the second sub-operation circuit includes a second difference circuit, the third sub-operation circuit includes an inverting amplifying circuit, the fourth sub-operation circuit includes a summing circuit, and the fifth sub-operation circuit includes an inverting circuit.

For example, in a pixel data compensation device provided by an embodiment of the present disclosure, the third sub-operation circuit includes an operational amplifier, a first resistor and a variable resistor sub-circuit, an inverting terminal of the operational amplifier is coupled to the first input terminal of the third sub-operation circuit through the first resistor, and the variable resistor sub-circuit is bridged between an output of the operational amplifier and the inverting terminal.

For example, in a pixel data compensation device provided by an embodiment of the present disclosure, the variable resistor sub-circuit includes a plurality of series-connected base resistors and a plurality of switches connected in parallel with the base resistors, and is configured to obtain a desired resistance value by selecting on/off states of the switches connected in parallel with the corresponding base resistor.

For example, in a pixel data compensation device provided by an embodiment of the present disclosure, the variable resistor sub-circuit further includes a counter and an encoder, wherein the counter is coupled to a row sync signal controller and a field sync signal controller, and is configured to count a row number n of a currently-switched-on row of sub-pixels according to a row sync signal of the row sync signal controller and a field sync signal of the field sync signal controller; and the encoder is coupled to the plurality of switches connected in parallel with the base resistors and the counter, and is configured to encode according to a counting result of the counter, and issue a control signal for controlling the on/off states of the plurality of switches to adjust the resistance value of the variable resistor sub-circuit.

For example, in a pixel data compensation device provided by an embodiment of the present disclosure, a resistance value of the variable resistor sub-circuit is (N−n)R, and a resistance value of the first resistor is (N−1)R.

At least one embodiment of the present disclosure also provides a display device, which includes a pixel data compensation device provided by any embodiment of the present disclosure.

For example, a display device according to an embodiment of the present disclosure further includes a source electrode driver circuit, wherein the source electrode driver circuit includes the pixel data compensation device.

For example, a display device according to an embodiment of the present disclosure further includes a digital-to-analog converter and a buffer, the digital-to-analog converter is configured to convert an input display data, and output the converted input display data to the buffer for amplification to obtain the initial pixel data $V_{data}$; and the pixel data compensation device is coupled to an output terminal of the buffer to compensate the initial pixel data $V_{data}$.

BRIEF DESCRIPTION OF THE DRAWINGS

In order to more clearly explain the embodiments of the present disclosure or the technical scheme in the state of art, in the following the drawings needed in the description of the embodiment or the state of art will be briefly introduce. Obviously, the drawings in the following description are only some embodiments of the present disclosure. For those of ordinary skill in the art, other drawings can be obtained according to these drawings without creative work.

DETAILED DESCRIPTION

Figure 1A:
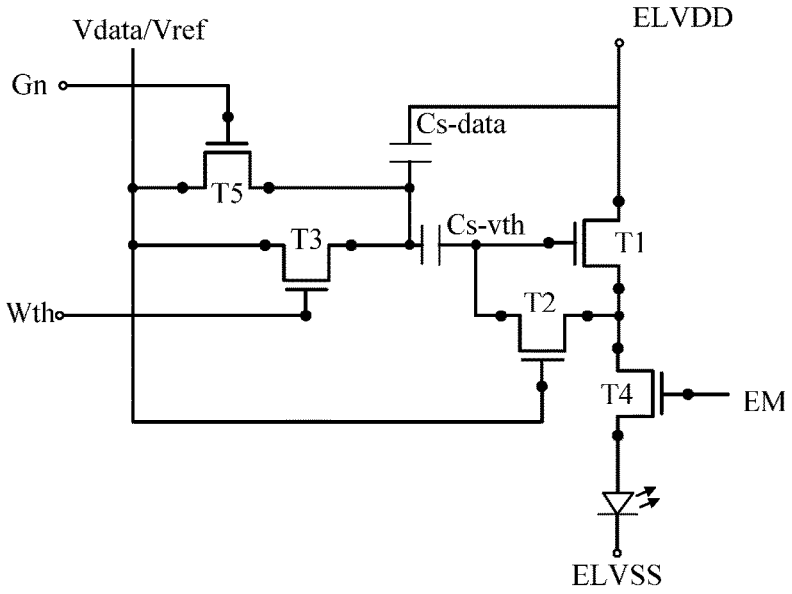
FIG. 1A is a schematic diagram of a structure of a pixel drive circuit.

In order to make objects, technical details and advantages of the embodiments of the invention apparent, the technical solutions of the embodiments will be described in a clearly and fully understandable way in connection with the drawings related to the embodiments of the invention. Apparently, the described embodiments are just a part but not all of the embodiments of the invention. Based on the described embodiments herein, those skilled in the art can obtain other embodiment(s), without any inventive work, which should be within the scope of the invention.

Unless otherwise defined, all the technical and scientific terms used herein have the same meanings as commonly understood by one of ordinary skill in the art to which the present invention belongs. The terms "first," "second," etc., which are used in the description and the claims of the present application for invention, are not intended to indicate any sequence, amount or importance, but distinguish various components. Also, the terms such as "a," "an," etc., are not intended to limit the amount, but indicate the existence of at least one. The terms "comprise," "comprising," "include," "including," etc., are intended to specify that the elements or the objects stated before these terms encompass the elements or the objects and equivalents thereof listed after these terms, but do not preclude the other elements or objects. The phrases "connect", "connected", etc., are not intended to define a physical connection or mechanical connection, but may include an electrical connection, directly or indirectly. "On," "under," "right," "left" and the like are only used to indicate relative position relationship, and when the position of the object which is described is changed, the relative position relationship may be changed accordingly.

The embodiments of the present disclosure are described in detail below, and the examples of the embodiments are illustrated in the drawings; the same or similar reference numerals are used to refer to the same or similar elements or elements having the same or similar functions. The embodiments described below with reference to the accompanying drawings are intended to be illustrative to the present disclosure, and are not to be construed as limitation to the embodiments of the present disclosure.

Figure 1B:
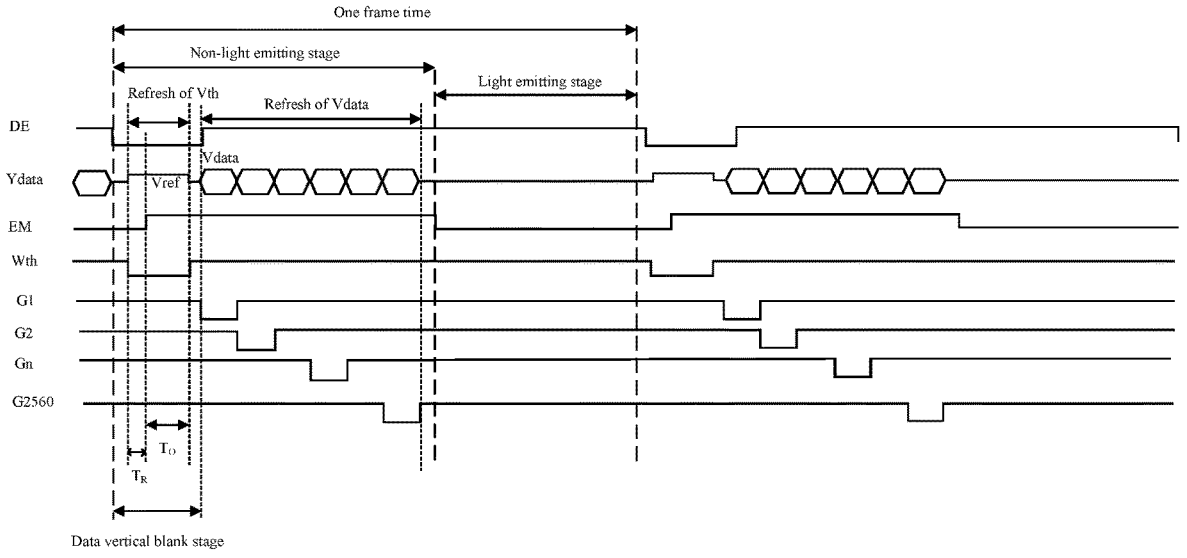
FIG. 1B is a timing-sequence control diagram of a pixel drive circuit.

An OLED display device generally drives a light emitting diodes (LED) to emit light through a pixel drive circuit to realize display of a picture. For example, as shown in FIG. 1A and FIG. 1B (which is a timing-sequence control diagram of FIG. 1A), FIG. 1A is a schematic diagram of a pixel drive circuit, which is generally divided into a non-light emitting stage and a light emitting stage (as shown in FIG. 1B) during a drive process. For example, in the non-light emitting stage, a threshold voltage $V_{th}$ of a driving transistor T1 and a pixel data voltage $V_{data}$ are input to a threshold voltage storage capacitor Cs-vth and a data storage capacitor Cs-data, respectively, and after all the pixel data voltages $V_{data}$ are input, all pixels are lit at the same time (that is, one frame is displayed).

However, because the process of inputting the pixel data $V_{data}$ to the data storage capacitor Cs-data has a certain timing-sequence (referring to a gate scanning signal G1 of a first row pixel drive circuit and a gate scanning signal G2 of a second row pixel drive circuit of FIG. 1B), that is to say, the pixel data $V_{data}$ needs to be sequentially input to the pixel drive circuits row by row in the order of the first row, the second row, the third row, and so on. In this way, as for the data storage capacitor Cs-data and the threshold voltage storage capacitor Cs-vth, a pixel data voltage $V_{data}$ and a threshold voltage $V_{th}$ of the pixel drive circuit in the first row G1 are stored for the longest time, and a pixel data voltage $V_{data}$ and a threshold voltage $V_{th}$ of the pixel drive circuit in the last row are stored for the shortest time (for example, in a mobile phone screen with a resolution of 2560×1440, the last row is the row G2560). Because a pixel drive circuit inevitably suffers from an electric leakage phenomenon, the electric leakage of the data storage capacitor Cs-data in the first row is the most serious (due to a long storage time), and the electric leakage of the data storage capacitor Cs-data in the last row is the smallest (that is, the degree of the electric leakage is gradually reduced from row to row), therefore, in the actual display process, the display brightness of the OLEDs of pixels of the first row and that of the last row of pixels are different, resulting in unevenness over the displayed image.

At least one embodiment of the present disclosure provides a pixel data compensation method of a display device, the display device including N rows of sub-pixels, the pixel data compensation method including: obtaining, for a sub-pixel of an n-th row in a column, a pixel compensation quantity Q of the sub-pixel, according to a row compensation coefficient $K_n$ of the n-th row of sub-pixels and a voltage deviation $\Delta V_{data}$ corresponding to an initial pixel data $V_{data}$ of the sub-pixel; and compensating the initial pixel data $V_{data}$ of the sub-pixel according to the pixel compensation quantity Q of the sub-pixel to obtain a compensated pixel data $V'_{data}$ the sub-pixel; the row compensation coefficient $K_n$ decreases of as a row number of the row in which the sub-pixel is located increases, and $0 \le K_n \le 1$, $1 \le n \le N$, and $1 \le N$.

The pixel data compensation method of the display device provided by the embodiment of the present disclosure can compensate a pixel data of a sub-pixel according to an initial pixel data of the sub-pixel and the row position of the sub-pixel. Therefore, the disadvantages such as abnormality of the display screen caused by the deviations between the initial pixel data and the pixel data stored in the storage capacitors in each row of the sub-pixels due to various factors such as electric leakage are avoided.

Figure 2:
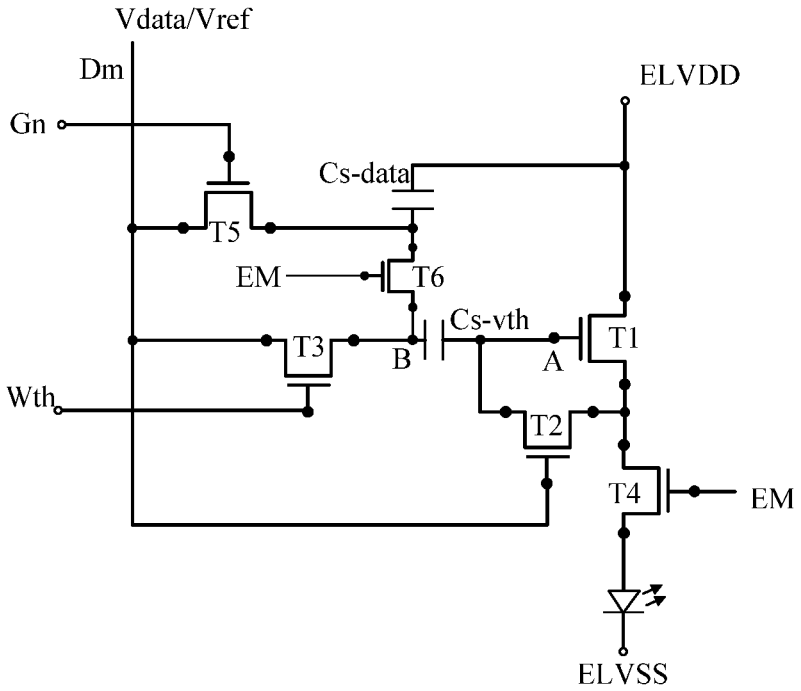
FIG. 2 is a structural schematic diagram of a pixel drive circuit according to an embodiment of the present disclosure.

First, it should be noted that the present disclosure is not limited to a specific configuration manner of the pixel drive circuit in the display device, it may be the pixel drive circuit as shown in FIG. 1A in the background portion, or may also be the pixel drive circuit as shown in FIG. 2 (compared to the pixel drive circuit as shown in FIG. 1A, the sixth transistor T6 between the threshold voltage storage capacitor Cs-vth and the data storage capacitor Cs-data is added). Of course, other kinds of pixel drive circuits may also be used, and the present disclosure does not specifically limit in this aspect. As long as the pixel drive circuit is in the process of drive row by row, the problem that a drive voltage of a driving transistor is abnormal due to a change of the capacitance stored in the data storage capacitor Cs-data and the threshold voltage storage capacitor Cs-vth (Generally due to leakage, but not completely limited to this) can be compensated by the pixel data compensation method in the embodiment of the present disclosure.

The pixel data compensation method provided in an embodiment of the present disclosure will be specifically described below with reference to the accompanying drawings.

Figure 3:
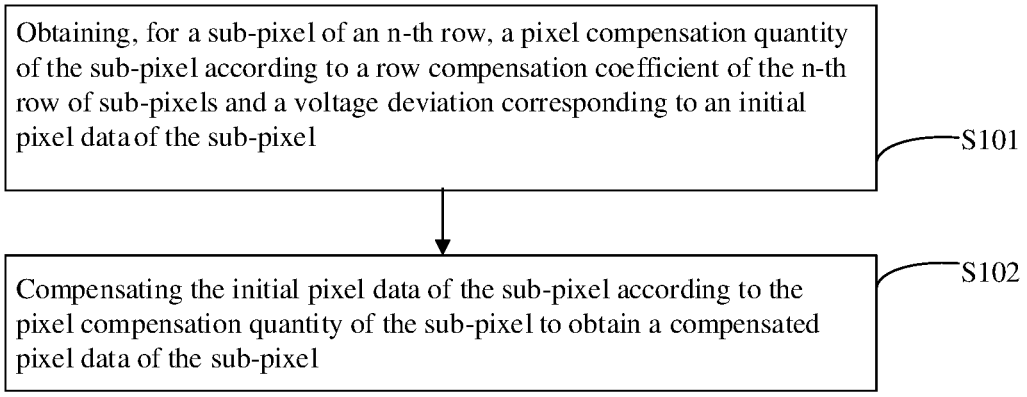
FIG. 3 is a flowchart of a pixel data compensation method according to an embodiment of the present disclosure.

FIG. 3 is a flowchart of a pixel data compensation method of a display device according to an embodiment of the present disclosure. For example, the display device may be an organic light emitting diode display device or other type of display device, and the embodiments of the present disclosure is not limited to this case. The following description is conducted by an example of an organic light emitting diode display device. For example, the pixel data compensation method can be implemented at least in part by software, hardware or firmware, and any combination thereof, to solve the above problem of the unevenness of image display due to electric leakage.

Hereinafter, taking a display device including N rows of sub-pixels as an example (N is a positive integer greater than or equal to 1), for example, a display screen with a resolution of 2560×1440 is taken as an example and N is 2560. The specific value of N is not limited in the embodiments of the present disclosure. In the embodiments of the present disclosure, when an actual frame-scan of the display device is performed, the first switched-on row of sub-pixels is the first row of sub-pixels, and so on, and the last switched-on row of sub-pixels is the last row of sub-pixels (the 2560-th row) is taken as an example for explanation. For example, for a display device that uses a forward scan (from top to bottom), the topmost row of sub-pixels is the first row of sub-pixel, and the lowest row of sub-pixels is the 2560-th row of sub-pixels; for another example, for a display device that uses reverse scan (from bottom to top), the lowest row of sub-pixels is the first row of pixels, and the topmost row of sub-pixels is the 2560-th row of pixels.

On the basis of the above, as shown in FIG. 3, the pixel data compensation method in the present disclosure includes steps S101 to S102.

Step S101: obtaining, for a sub-pixel of an n-th row (that is, for any row, and n is a positive integer greater than or equal to 1 and less than or equal to N), a pixel compensation quantity Q of the sub-pixel, according to a row compensation coefficient $K_n$ of the n-th row of sub-pixels and a voltage deviation $\Delta V_{data}$ corresponding to an initial pixel data $V_{data}$ (i.e., actual pixel data) of the sub-pixel.

For example, the row compensation coefficient $K_n$ decreases as the row number of the row of sub-pixels increases, and $0 \le K_n \le 1$, $1 \le n \le N$, and $1 \le N$.

For example, the voltage deviation $\Delta V_{data}$ corresponding to the initial pixel data $V_{data}$ of the sub-pixel is a voltage difference between the voltage of a gate electrode of a driving transistor of a sub-pixel of the first row and the voltage of a gate electrode of a driving transistor of a sub-pixel of the last row in a case where each row of sub-pixels is driven row by row using the same initial pixel data $V_{data}$. For example, the display device may further include a digital-to-analog converter (DAC) and a buffer, and step S101 may further include converting an input display data by the digital-to-analog converter and amplifying a converted input display data by the buffer to obtain the initial pixel data $V_{data}$. For example, the display device may further include a gamma circuit or the like, which is not limited by the embodiments of the present disclosure.

Of course, it should be understood that the pixel data compensation for sub-pixels herein is described by taking the entire compensation process of same one sub-pixel as an example; and it should also be understood that the minimum compensation unit in the present disclosure is a sub-pixel, and thus the initial pixel data, the compensated pixel data, and the like herein are all for the smallest light-emitting unit (i.e., sub-pixel) in the display device.

Step S102: compensating the initial pixel data $V_{data}$ of the sub-pixel according to the pixel compensation quantity Q of the sub-pixel to obtain a compensated pixel data $V'_{data}$ of the sub-pixel.

It should be noted here that each pixel in the display screen can be compensated by the pixel data compensation method in the present disclosure, so in practice, for example, pixel data compensation can be performed for all sub-pixels of each row. In this case, for example, a display device includes M columns of sub-pixels is taken as an example, then, for the sub-pixels of the n-th row, it is necessary to obtain the pixel compensation quantities Q of the M sub-pixels according to the row compensation coefficient $K_n$ of the n-th row of sub-pixels and M voltage deviations $\Delta V_{data}$ corresponding to the initial pixel data $V_{data}$ of M sub-pixels (various identical $V_{data}$ may exist depending on the actually displayed image) according to step S101. Then, according to step S102, the initial pixel data $V_{data}$ of the corresponding M sub-pixels are respectively compensated according to the pixel compensation quantities Q of the M sub-pixels, thereby obtaining the compensated pixel data $V'_{data}$ of the M sub-pixels of the row.

In summary, the pixel data compensation method of the display device provided by the embodiment of the present disclosure can compensate a pixel data of a sub-pixel according to an initial pixel data of the sub-pixel and the row position of the sub-pixel. Therefore, the disadvantages such as abnormality of the displayed image caused by the deviations between the initial pixel data and the pixel data stored in the storage capacitors in each row of the sub-pixels due to various factors such as electric leakage are avoided.

The above step S101 will be further described.

For the row compensation coefficient $K_n$ in step S101, as described above, the row compensation coefficient $K_n$ decreases as the row number n of the row of sub-pixels increases. A specific calculation manner of the row compensation coefficient $K_n$ is not specifically limited in the present disclosure. Specifically, the row compensation coefficient of the n-th row of sub-pixels may be expressed as $$K_n = \frac{N-n}{N-1}$$

(or may be an approximate value of $$K_n = \frac{N-n}{N-1},$$

which is $$K_n = \frac{N-n}{N});$$

or based on row compensation coefficient $$K_n = \frac{N-n}{N-1},$$

a certain coefficient correction or offset may be performed on the formula according to actual conditions; of course, other calculation manners may be used. The embodiments of the present disclosure are not specifically limited in this aspect. The following embodiments further illustrate the present disclosure by taking the row compensation coefficient $$K_n = \frac{N-n}{N-1}$$

as an example.

In addition, in the above step S101, as described above, the voltage deviation $\Delta V_{data}$ corresponding to the initial pixel data $V_{data}$ of the sub-pixel is the voltage difference between the voltage of a gate electrode of a driving transistor of a sub-pixel of the first row and the voltage of a gate electrode of a driving transistor of a sub-pixel of the last row in a case where each row of sub-pixels is driven row by row using the same initial pixel data $V_{data}$, that is to say, there are different voltage deviations $\Delta V_{data}$ for different initial pixel data $V_{data}$.

With reference to the above description, in the embodiments of the present disclosure, the pixel compensation quantity Q of a sub-pixel can be more comprehensively and accurately obtained, according to the row compensation coefficient $K_n$ of the row of the sub-pixel and the voltage deviation $\Delta V_{data}$ corresponding to the initial pixel data $V_{data}$ of the sub-pixel. However, in the embodiments of the present disclosure, a specific calculation manner of obtaining the pixel compensation quantity Q of the sub-pixel by using the row compensation coefficient $K_n$ and the voltage deviation $\Delta V_{data}$ corresponding to the initial pixel data $V_{data}$ of the sub-pixel is not limited. Specifically, the pixel compensation quantity Q may be calculated according to the relation $Q=K_n \cdot \Delta V_{data}$, or on the basis of $Q=K_n \cdot \Delta V_{data}$, a certain coefficient correction or offset may be performed to the relation according to the actual situations. Of course, other calculation manners may be used. The embodiments of the present disclosure are not specifically limited to this case, and the following embodiments are all described by taking $Q=K_n \cdot \Delta V_{data}$ as an example to further explain the present disclosure.

In addition, for the specific relationship between the initial pixel data $V_{data}$ of the sub-pixel and the voltage deviation $\Delta V_{data}$ corresponding to the initial pixel data $V_{data}$ in the above step S101, after repeated data simulation and specific practice, the inventors of the present application finally obtains, the voltage deviation $\Delta V_{data}$ corresponding to the initial pixel data $V_{data}$ of different sub-pixel is approximately linear with the difference $(V_{data}-V_{ref})$ between the initial pixel data $V_{data}$ of the sub-pixel and a charging reference voltage $V_{ref}$ of the storage capacitor for compensating the threshold voltage of the driving transistor in the actual display process. That is, the voltage deviation $\Delta V_{data}$ corresponding to the initial pixel data $V_{data}$ of the sub-pixel and the initial pixel data $V_{data}$ of the sub-pixel satisfy the following relationship:

$$\Delta V_{data}=\alpha(V_{data}-V_{ref})+\beta \quad 1)$$

where α, β are compensation coefficients and are constants for the display device; and $V_{ref}$ is the charging reference voltage of the storage capacitor for compensating the threshold voltage of the driving transistor in the sub-pixel and is a known parameter that is set artificially, and it can be set according to experience and specific conditions.

In addition, in the foregoing step S102, a specific calculation manner for calculating the compensated pixel data $V'_{data}$ the sub-pixel for the initial pixel data $V_{data}$ of the sub-pixel according to the pixel compensation quantity Q of the sub-pixel is not limited. Actually, it is possible to choose and set a calculation manner according to actual needs.

For example, in order to ensure that the compensated pixel data $V'_{data}$ of the sub-pixel is finally obtained as close as possible or equal to the initial pixel data $V_{data}$ of the sub-pixel, it is necessary to select to add the pixel compensation quantity Q of the sub-pixel to the initial pixel data $V_{data}$ of the sub-pixel or subtract the pixel compensation quantity Q of the sub-pixel from the initial pixel data $V_{data}$ of the sub-pixel according to the type of the voltage deviation $\Delta V_{data}$ corresponding to the initial pixel data $V_{data}$ of the sub-pixel.

Specifically, when the display device scans the sub-pixels row by row, if the electric quantity stored in the storage capacitors (including the storage capacitor Cs-data of the pixel data and the storage capacitor Cs-vth of the threshold voltage) of each row of sub-pixels is increases row by row (that is, the electric quantity stored in the storage capacitor in the first row drops the most, and the electric quantity stored in the storage capacitor in the last row remains basically the same), it is necessary to add the pixel compensation quantity Q to the initial pixel data $V_{data}$ of the sub-pixel.

When the display device scans the sub-pixels row by row, if the electric quantity stored in the storage capacitors (including the storage capacitor Cs-data of the pixel data and the storage capacitor Cs-vth of the threshold voltage) of each row of sub-pixels decreases row by row (that is, the electric quantity stored in the storage capacitor in the first row rises the most, and the electric quantity stored in the storage capacitor in the last row remains basically the same), it is necessary to subtract the pixel compensation quantity Q from the initial pixel data $V_{data}$ of the sub-pixel.

Figure 4:
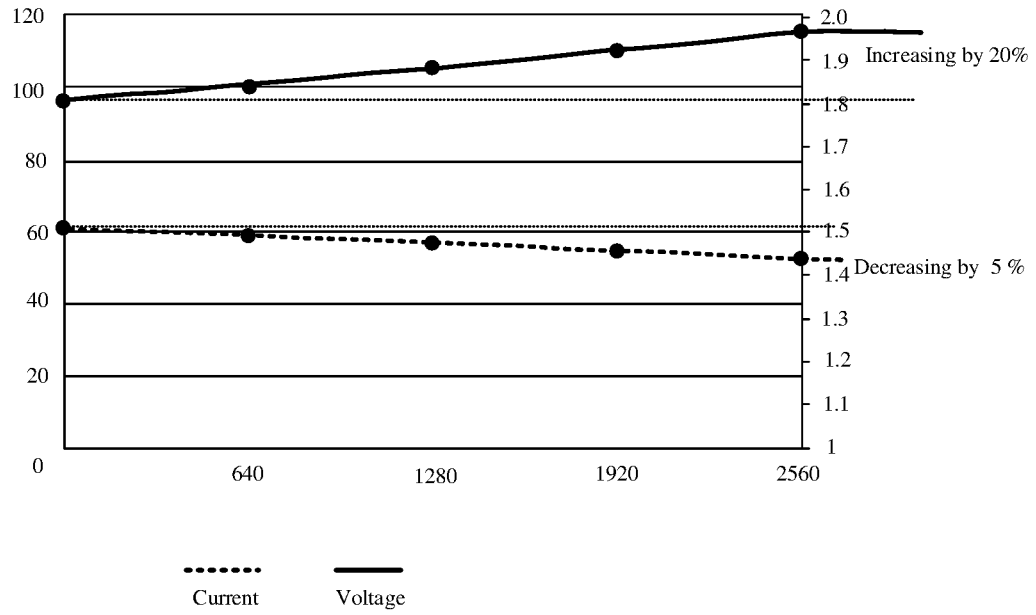
FIG. 4 is a schematic diagram of electric leakage of a display device according to an embodiment of the present disclosure.

The following are considered. The pixel drive circuit, for example as shown in FIG. 1A or FIG. 2, presents the above phenomenon that the electric quantity stored in the storage capacitors in each row of sub-pixels decreases row by row (that is, the electric quantity stored in the storage capacitor in the first row rises the most, and the electric quantity stored in the storage capacitor in the last row remains basically the same) mainly due to electric leakage. Specifically, referring to FIG. 4, it can be seen that the voltage of the gate electrode of the driving transistor (the first transistor T1 in FIG. 2) a sub-pixel of in the last row is decreased by about 5% compared to the voltage of the gate electrode of the driving transistor a sub-pixel of in the first row, and the current flowing through LED in the last row of sub-pixels is increased by 20% compared to the current flowing through LED in the first row of sub-pixels, and the overall trend is:

as the row number (abscissa) of the row of sub-pixels increases gradually, the voltage of the gate electrode of the driving transistor gradually decreases (mainly due to electric leakage, causing the charge of the storage capacitor in the previous row of sub-pixels to increase), causing the currents respectively flowing through the LEDs increases row by row, thereby causing unevenness of the display image.

Based on the above, for example, in the embodiments of the present disclosure, the initial pixel data $V_{data}$ may be compensated by subtracting the pixel compensation quantity Q of the sub-pixel from the initial pixel data $V_{data}$ of the sub-pixel to ensure that the compensated pixel data $V'_{data}$ of the sub-pixel is as close as possible or equal to the initial pixel data $V_{data}$, so as to reduce or avoid display defects such as uneven display of the display panel caused by different electric leakage levels of storage capacitors in the pixel drive circuits due to different storage time duration.

Of course, in the embodiments of the present disclosure, a specific calculation manner of calculating the compensated pixel data $V'_{data}$ of the sub-pixel by subtracting the pixel compensation quantity Q of the sub-pixel from the initial pixel data $V_{data}$ of the sub-pixel is not limited. It may be calculated according to the relation $V'_{data}=V_{data}-Q$; or it may be also performed a certain coefficient correction, offset (in whole or in part) or the like to the relation on the basis of $V'_{data}=V_{data}-Q$ according to the actual situation; of course, other calculation methods may be used. This disclosure does not specifically limit this. The following embodiments further be illustrated in the present disclosure by taking $V'_{data}=V_{data}-Q$ as an example.

On the basis of this, the pixel drive circuit shown in FIG. 2 is taken as an example (referring to the timing-sequence diagram of FIG. 1B) to further illustrate the linear relationship of the voltage deviation $\Delta V_{data}$ corresponding to the initial pixel data $V_{data}$ of the sub-pixel and the difference ($V_{data}-V_{ref}$) between the initial pixel data $V_{data}$ of the sub-pixel and the charging reference voltage $V_{ref}$ of the storage capacitor for compensating the threshold voltage of the driving transistor.

First, referring to the pixel drive circuit in FIG. 2 and the timing-sequence control diagram in FIG. 1B, one frame time period is mainly divided into three stages. A first stage is a refresh stage of the threshold voltage $V_{th}$, which is designed in a data vertical blank stage; a second stage is a refresh stage of the data signal $V_{data}$, and a third stage is an OLED lighting stage. For example, as shown in FIG. 1B, the first stage and the second stage are non-light emitting stages, and the third stage is a light emitting stage.

Specifically, the refresh stage of the threshold voltage $V_{th}$ is described below:

In order to ensure that the threshold voltage $V_{th}$ of the driving transistor T1 is written into the storage capacitor Cs-vth at this stage, first, in the reset stage $T_R$, the second transistor T2, the third transistor T3, the fourth transistor T4, and the sixth transistor T6 are all in an on-state. At this time, the voltage of the point A of the storage capacitor Cs-vth is clamped to the anode voltage of the OLED, and this voltage is generally lower than the value of ELVDD-$V_{th}$, that is, the storage capacitor Cs-vth is reset.

After resetting the storage capacitor Cs-vth, the threshold voltage compensation stage $T_o$ occurs, in which the second transistor T2, the third transistor T3 remain in the on-state, and the reference voltage $V_{ref}$ is input through the data line Dm. At this time, the driving transistor T1 functions as a diode, and the voltage difference between ELVDD and $V_{ref}$ is charged to the storage capacitor Cs-vth through the driving transistor T1. For example, at this time, ELVDD charges the point A of the storage capacitor Cs-vth through the driving transistor T1 and the second transistor T2, and the reference voltage $V_{ref}$ charges the point B of the storage capacitor Cs-vth, thus, the voltage charged into the storage capacitor Cs-vth is ELVDD-$V_{th}-V_{ref}$, that is to say, the threshold voltage $V_{th}$ information of the driving transistor T1 is recorded into the storage capacitor Cs-vth at this stage.

The refresh stage of the data signal $V_{data}$ described below.

In this stage, the second transistor T2, the third transistor T3, the fourth transistor T4, and the sixth transistor T6 are all in an off-state, at this time, the driving transistor T1 loses the diode characteristic and is in an off-state, and the voltage $C_{GS}$ of the driving transistor is small and can be ignored. In this stage, the fifth transistor T5 remains in an on-state, the signal loaded through the data line Dm is converted from $V_{ref}$ to the $V_{data}$ signal, and the data voltage (pixel data) $V_{data}$ is written into the storage capacitor Cs-data.

The OLED lighting stage is described below.

In this stage, the second transistor T2, the third transistor T3, and the fifth transistor T5 are all in an off-state, and the fourth transistor T4 and the sixth transistor T6 are in an on-state, at this time, the voltage formed by the charge stored into the storage capacitor Cs-data and the storage capacitor Cs-vth is applied to the gate electrode and the source electrode of the driving transistor T1, and the driving transistor T1 is in an on-state according to the voltage across the capacitor. At this time, the voltage $V_G$ of the gate electrode of the driving transistor T1 is $V_{data}$+ELVDD−$V_{th}-V_{ref}$, and the voltage $V_S$ of the source electrode of the driving transistor T1 is ELVDD.

Specifically, the value of the drive current $I_d$ flowing through the light-emitting element can be obtained according to the following formula:

$$I_d = \frac{W\mu_p C_{ox}}{2L} V_d^2 = \frac{W\mu_p C_{ox}}{2L}(V_{GS} + V_{TH})^2 = \frac{W\mu_p C_{ox}}{2L}[(V_{data} + V_{ref})]^2 \quad 2)$$

In the relation $$I_d = \frac{W\mu_p C_{ox}}{2L}(V_{data} + V_{ref})^2, \frac{W}{L}$$

is an aspect ratio of the driving transistor, $\mu_p$ is a carrier mobility, C is a capacitance related to the gate electrode, which are all known parameters; that is to say, the drive current $I_d$ in the pixel drive circuit is related to ($V_{data}-V_{ref}$) only.

Figure 5:
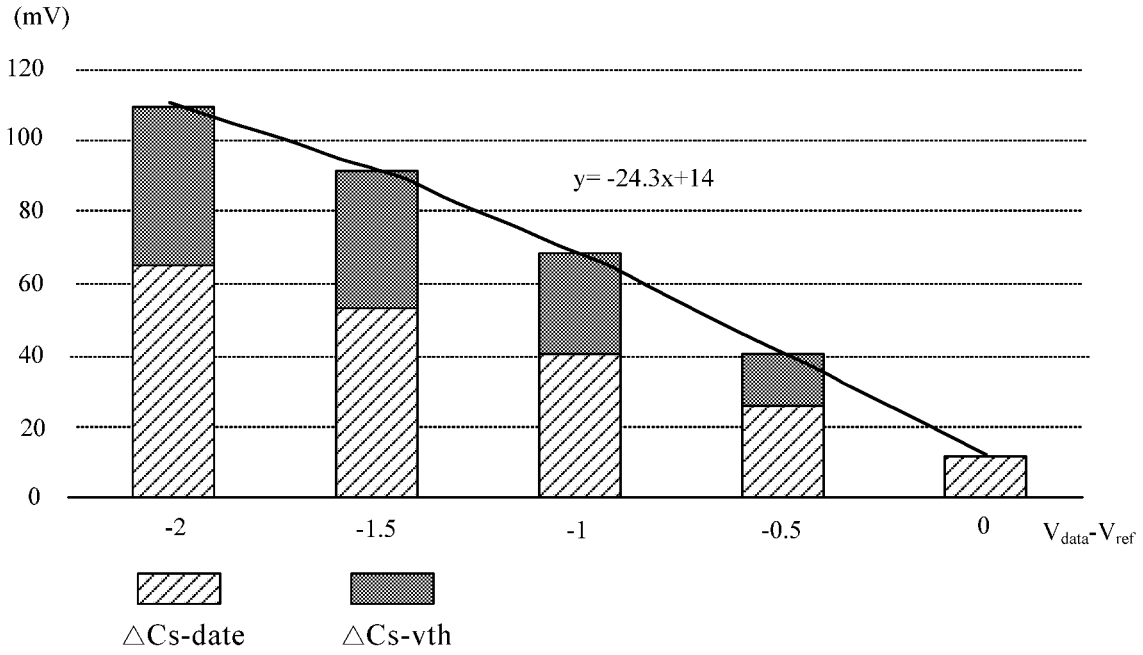
FIG. 5 is a schematic diagram of a voltage deviation $\Delta V_{data}$ and a voltage ($V_{data}-V_{ref}$) of a display device according to an embodiment of the present disclosure.

Based on the above, referring to FIG. 5, the inventors actually obtains that: the difference ($V_{data}-V_{ref}$) between the initial pixel data $V_{data}$ of the sub-pixel and the charging reference voltage $V_{ref}$ of the storage capacitor for compensating the threshold voltage of the driving transistor, and the total amount of change ΔCs-data+ΔCs-vth between the storage capacitor Cs-data and the storage capacitor Cs-vth in the first row of sub-pixels and the storage capacitor Cs-data and the storage capacitor Cs-vth in the last row of sub-pixels as for the same initial pixel data $V_{data}$ (that is, the height of a column in FIG. 5) satisfy a linear relation y=−24.3x+14, i.e., the difference ($V_{data}-V_{ref}$) and the aforementioned voltage deviation $\Delta V_{data}$ corresponding to the initial pixel data $V_{data}$ satisfy the linear relation y=−24.3x+14 (where y is equivalent to $\Delta V_{data}$ and x is equivalent to $V_{data}-V_{ref}$).

In this case, those skilled in the art should understand that in a case where process parameters and a timing-sequence of drive of the display device are determined, the slope (−24.3) and the offset (14) for the above relation y=−24.3x+14 are both known parameters, that is, α=−24.3 and β=14 are both known parameters for the aforementioned $\Delta V_{data}=\alpha(V_{data}-V_{ref})+\beta$. It should be noted that the values of a and may be determined depending on actual cases, and the embodiments of the present disclosure are not limited in this aspect.

In summary, in combination with the relation $\Delta_{data}=\alpha(V_{data}-V_{ref})+\beta$, and the foregoing calculation relation $Q=K_n\cdot\Delta V_{data}$ and $V'_{data}-Q$, it can be known that, for example, in the pixel data compensation method provided in the embodiments of the present disclosure, the compensated pixel data of the sub-pixel is $$V'_{data}=V_{data}-\frac{N-n}{N-1}\cdot[\alpha(V_{data}-V_{ref})+\beta].$$

Figure 6:
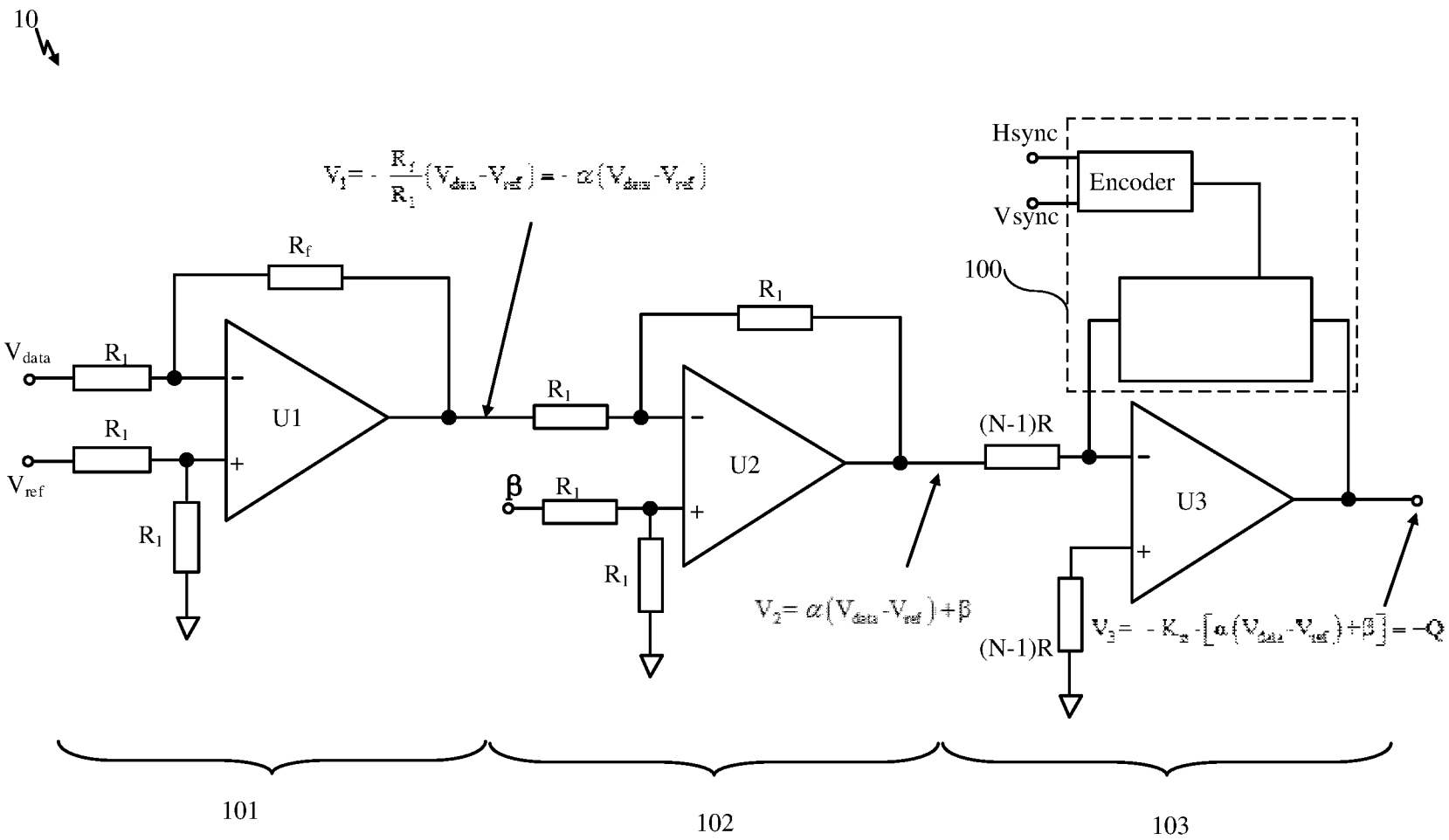
FIG. 6 is a partial structural schematic diagram of a pixel data compensation device according to an embodiment of the present disclosure.
Figure 7:
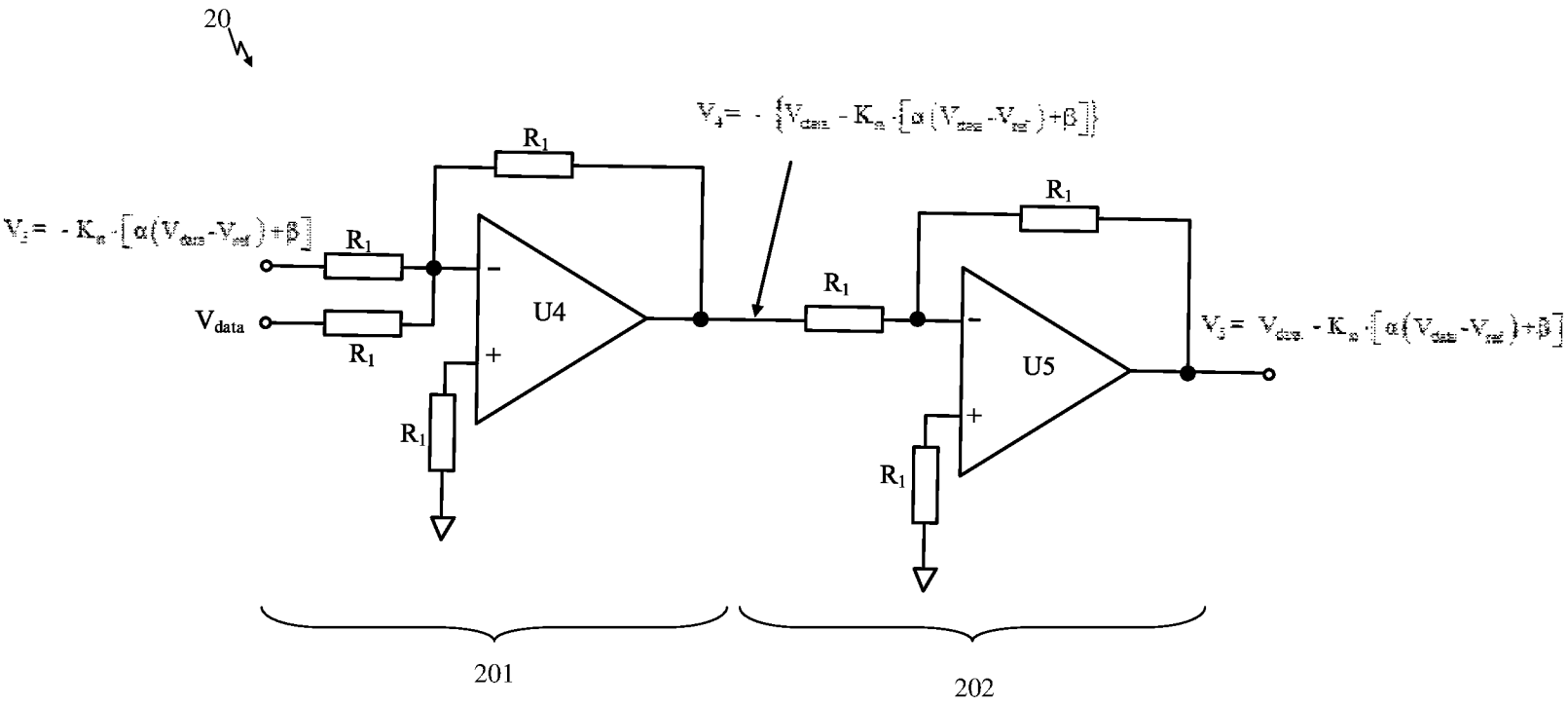
FIG. 7 is a partial structural schematic diagram of a pixel data compensation device according to an embodiment of the present disclosure.

The embodiments of the present disclosure further provides a pixel data compensation device (or a pixel data compensation circuit) of a display device. Because in practice, the compensation is mainly for the voltage difference caused by electric leakage, the pixel data compensation device may also be referred to as a leakage compensate circuit (LCC). For example, the pixel data compensation device can compensate the pixel data of a pixel drive circuit by the pixel data compensation method provided by any embodiment of the present disclosure, thereby avoiding problems such as uneven display of the display panel due to electric leakage. For example, the display device includes N rows of sub-pixels, and the pixel data compensation device includes a pixel compensation quantity operation circuit (for example, the pixel compensation quantity operation circuit 10 as shown in FIG. 6) and a compensation pixel data operation circuit (for example, the compensation pixel data operation circuit 20 as shown in FIG. 7).

The pixel compensation quantity operation circuit 10 is configured to obtain, for a sub-pixel of an n-th row, a pixel compensation quantity Q of the sub-pixel according to a row compensation coefficient $K_n$ of the n-th row of sub-pixels and a voltage deviation $\Delta V_{data}$ corresponding to an initial pixel data $V_{data}$ of the sub-pixel.

For example, the row compensation coefficient $K_n$ decreases as the row number of the row of sub-pixels increases, and $0\le K_n\le 1$, $1\le n\le N$, and $1\le N$. For example, the voltage deviation $\Delta V_{data}$ corresponding to the initial pixel data $V_{data}$ of the sub-pixel is a voltage difference between the voltage of a gate electrode of a driving transistor of a sub-pixel of the first row and the voltage of a gate electrode of a driving transistor of a sub-pixel of the last row in the case where each row of sub-pixels is driven row by row using same initial pixel data $V_{data}$.

The compensation pixel data operation circuit 20 is configured to compensate the initial pixel data $V_{data}$ of the sub-pixel according to the pixel compensation quantity Q of the sub-pixel to obtain a compensated pixel data $V'_{data}$ of the sub-pixel.

In summary, the pixel data compensation device of the display device provided by the embodiments of the present disclosure can compensate a pixel data of a sub-pixel according to an initial pixel data of the sub-pixel and the row position of the sub-pixel. Therefore, the disadvantages such as abnormality of the display screen caused by the deviations between the initial pixel data and the pixel data stored in the storage capacitors in each row of the sub-pixels due to various factors such as electric leakage are avoided.

Specifically, a specific setting of the pixel compensation quantity operation circuit and the compensation pixel data operation circuit will be further described below.

For example, the pixel compensation quantity operation circuit includes a first sub-operation circuit, a second sub-operation circuit, and a third sub-operation circuit. As shown in FIG. 6, the pixel compensation quantity operation circuit 10 may include a first difference circuit 101, a second difference circuit 102, and an inverting amplifying circuit 103. For example, the first sub-operation circuit includes the first difference circuit 101, the second sub-operation circuit includes the second difference circuit 102, and the third sub-operation circuit includes the inverting amplifying circuit 103. For example, in the embodiments of the present disclosure, the first difference circuit 101 is an example of the first sub-operation circuit, the second difference circuit 102 is an example of the second sub-operation circuit, and the inverting amplifying circuit 103 is an example of the third sub-operation circuit. Hereinafter, description is conducted by taking the first difference circuit 101 as the first sub-operation circuit, the second difference circuit 102 as the second sub-operation circuit, and the inverting amplifier circuit 103 as the third sub-operation circuit as an example for description. However, the embodiments of the present disclosure are not limited thereto, and the following embodiments are the same as those described herein, and are not described again.

For example, a non-inverting input terminal of the first difference circuit 101 (i.e., a first input terminal of the first sub-operation circuit) is coupled to a reference voltage terminal $V_{ref}$ (i.e., an input reference voltage $V_{ref}$), and an inverting input terminal (i.e., a second input terminal of the first sub-operation circuit) is coupled to an initial pixel data input terminal $V_{data}$ (that is, an input initial pixel data $V_{data}$), and an output terminal is coupled to an inverting input terminal of the second difference circuit 102 (i.e., a first input terminal of the second sub-operation circuit).

It should be noted that in the embodiments of the present disclosure, $V_{ref}$ may represent both the reference voltage terminal and the reference voltage, and $V_{data}$ may represent both the initial pixel data input terminal and the initial pixel data.

For example, as shown in FIG. 6, in the first difference circuit 101, the resistance value ratio of a resistor $R_f$ connected between the inverting terminal and the output terminal $V_1$ of the operational amplifier U1 to a resistor $R_1$ connected between the inverting input terminal $V_{data}$ and the inverting terminal of the operational amplifier U1 (i.e., $R_f/R_1$) is equal to α; that is, a voltage gain of the first difference circuit 101 is equal to α. In this case, the voltage of the output terminal $V_1$ of the first difference circuit 101 is $$V_1=-\frac{R_f}{R_1}(V_{data}-V_{ref}),$$

that is $V_1=-\alpha(V_{data}-V_{ref})$.

For example, as shown in FIG. 6, the inverting input terminal of the second difference circuit 102 receives the voltage $V_1=-\alpha(V_{data}-V_{ref})$ of the output terminal $V_1$ of the first difference circuit 101, and a non-inverting input terminal of the second difference circuit 102 (i.e., a second input terminal of the second sub-operation circuit) is coupled to a first voltage terminal β (for example, a first voltage of the first voltage terminal is β), and an output terminal $V_2$ of the second difference circuit 102 is coupled to an inverting input terminal of the inverting amplifying circuit 103. For example, a voltage gain of the second difference circuit is equal to 1, in this case, a voltage of the output terminal $V_2$ of the second difference circuit 102 is $V_2=\alpha(V_{data}-V_{ref})+\beta$. It should be noted that the voltage gain of the second difference circuit may be other values, which may be determined according to specific conditions, and the embodiments of the present disclosure are not limited in this aspect.

Further, for the inverting amplifying circuit 103, as shown in FIG. 6, an inverting input terminal of the inverting amplifying circuit 103 (i.e., a first input terminal of the third sub-operation circuit) receives the voltage $V_2=(V_{data}-V_{ref})$ 13 of the output terminal $V_2$ of the second difference circuit 102, for example, a voltage gain of the inverting amplifying circuit 103 is equal to $K_n$ (i.e., the aforementioned row compensation coefficient). For example, an output terminal $V_3$ of the inverting amplifier circuit 103 is coupled to the compensation pixel data operation circuit 20 to invert the obtained pixel compensation quantity of the sub-pixel and output an inverted pixel compensation quantity to the compensation pixel data operation circuit (specifically, the voltage of the output terminal of the inverting amplifying circuit 103 is $V_3=-K_n\cdot[a\ (V_{data}-V_{ref})+\beta]=-Q$ that is, the inverted data of the pixel compensation quantity Q of the sub-pixel.

Based on the above, for the compensation pixel data operation circuit, the compensation pixel data operation circuit includes a fourth sub-operation circuit and a fifth sub-operation circuit. As shown in FIG. 7, the compensation pixel data operation circuit 20 may include a summing circuit 201 and an inverting circuit 202. For example, the fourth sub-operation circuit includes the summing circuit 201, and the fifth sub-operation circuit includes the inverting circuit 202. For example, in the embodiments of the present disclosure, the summing circuit 201 is an example of the fourth sub-operation circuit, and the inverting circuit 202 is an example of the fifth sub-operation circuit. The following is an example in which the summing circuit 201 is the fourth sub-operation circuit, and the inverting circuit 202 is the fifth sub-operation circuit. However, the embodiments of the present disclosure are not limited thereto, and the following embodiments are the same, and are not described again.

Figure 8:
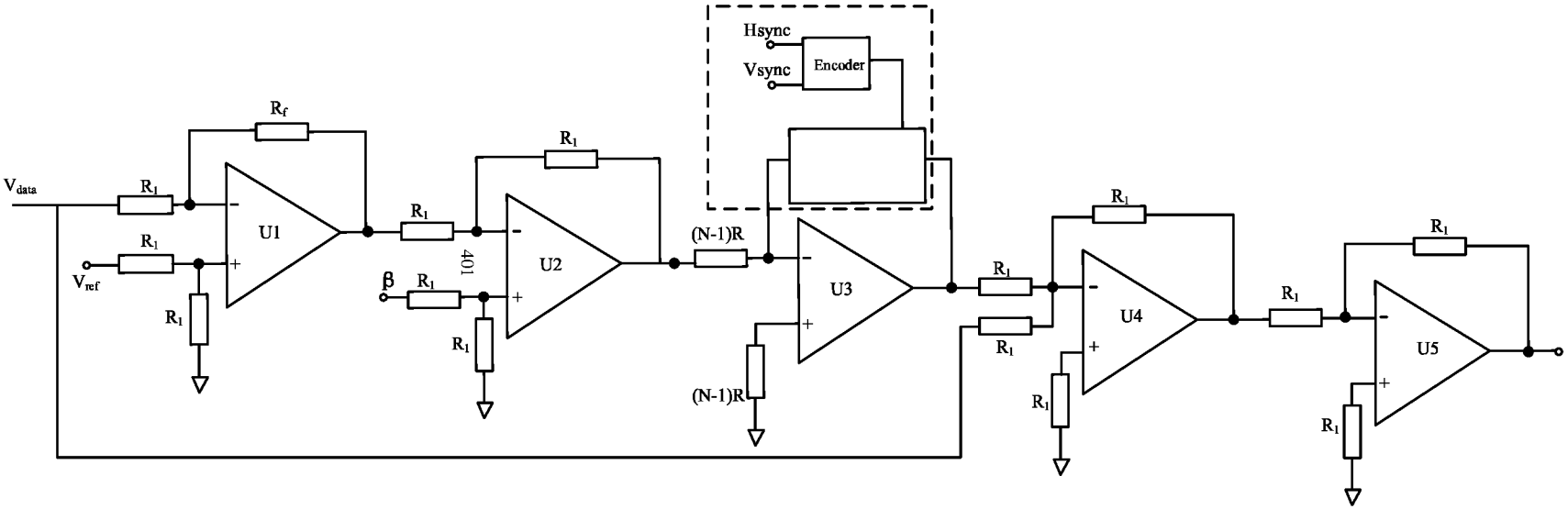
FIG. 8 is a schematic diagram of an overall structure of a pixel data compensation device according to an embodiment of the present disclosure.

For example, referring to FIG. 7, a first input terminal of the summing circuit 201 is coupled to the output terminal $V_3$ of the inverting amplifying circuit 103 in the pixel compensation quantity operation circuit 10 (referring to FIG. 8 as a whole) to receive the inverted pixel compensation quantity (that is, the voltage of the output terminal of the inverting amplifying circuit 103), a second input terminal of the summing circuit 201 is coupled to the initial pixel data input terminal $V_{data}$ for the sub-pixel (that is, the input initial pixel data $V_{data}$), an output terminal $V_4$ of the summing circuit 201 is coupled to an input terminal (an inverting input terminal) of the inverting circuit 202. For example, the voltage of the output terminal $V_4$ of the summing circuit 201 is $V_4=-\{V_{data}-K_n\cdot[\alpha(V_{data}-V_{ref})+\beta]\}$. The input terminal of the inverting circuit 202 receives the voltage $V_4$ and inverts the voltage, and an output voltage that is output through the output terminal $V_5$ of the inverting circuit 202 is $V_5=V_{data}-K_n\cdot[\alpha(V_{data}-V_{ref})+\beta]=V'_{data}$ (that is, the compensated pixel data of the sub-pixel). For example, a voltage gain of the summing circuit is equal to 1.

It should be noted that $V_1$ can represent both the output terminal of the first difference circuit and the voltage output by the output terminal of the first difference circuit. $V_2$ can represent both the output terminal of the second difference circuit and the voltage output by the output terminal of the second difference circuit. $V_3$ can represent both the output terminal of the inverting amplifying circuit and the voltage output by the output terminal of the inverting amplifying circuit. $V_4$ can represent both the output terminal of the summing circuit and the voltage output by the output terminal of the summing circuit. $V_5$ can represent both the output terminal of the inverting circuit and the voltage output from the output terminal of the inverting circuit. β can represent both the first voltage terminal and the first voltage (i.e., the compensation coefficient) of the first voltage terminal.

It should be noted that, as for the reason of the related setting and the specific setting value of the foregoing α and β, reference may be made to the description of the corresponding part in the foregoing embodiments of the pixel data compensation method, and details are not described herein again.

In addition, the inverting amplifying circuit 103 (referring to FIG. 6), the voltage gain of which is equal to $K_n$, is further described below.

The specific description of the row compensation coefficient $K_n$ in the embodiments of the foregoing pixel data compensation method shows that the magnitude of the compensation coefficient $K_n$ also changes as the row number n of the row of sub-pixels changes (the row compensation coefficient $K_n$ decreases as the row number n of the row of sub-pixels increases). Based on this, for the inverting amplifying circuit 103, the voltage gain thereof would also be a corresponding changed value. Based on this, in the embodiments of the present disclosure, a specific manner of setting the inverting amplifying circuit 103 with variable voltage gain is provided, but is not limitative.

Specifically, referring to FIG. 6, the inverting amplifying circuit 103 includes an operational amplifier U3, a first resistor (N−1)R (for example, its resistance value may be indicated as (N−1)R as well), and a variable resistor sub-circuit 100. For example, an inverting terminal of the operational amplifier U3 is coupled to the inverting terminal of the inverting amplifying circuit 103 through the first resistor (N−1)R, and the variable resistor sub-circuit 100 is connected between an output terminal of the operational amplifier U3 and the inverting terminal of the operational amplifier U3.

Figure 9:
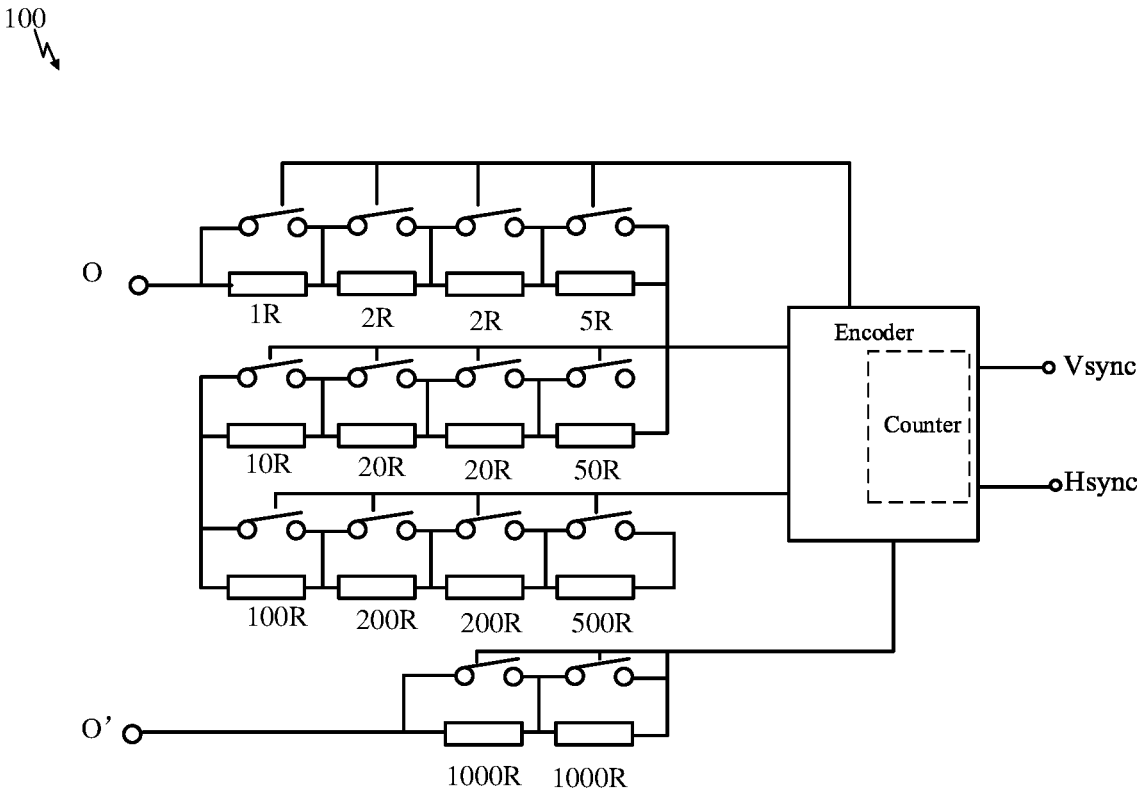
FIG. 9 is a partial structural schematic diagram of a pixel data compensation device according to an embodiment of the present disclosure.

As shown in FIG. 9, the variable resistor sub-circuit 100 is connected between the output terminal and the inverting terminal of the operational amplifier U3 through ports O and O'. The variable resistor sub-circuit 100 includes a plurality of series-connected base resistors (i.e., R-String) and a plurality of switches connected in parallel with the base resistors (i.e., Switch string), respectively, and is configured to obtain a desired resistance value by selecting the on/off states of the switches connected in parallel with the corresponding base resistors, respectively. For example, the variable resistor sub-circuit further includes a counter and an encoder. For example, the encoder is coupled to the switches and the counter (not shown in FIG. 6, and the counter can be integrated with the encoder).

For example, referring to FIG. 9, the counter is coupled to a row sync signal controller Hsync and a field sync signal controller Vsync, and is configured to count the row number n of the currently-switched-on row of sub-pixels according to a row sync signal of the row sync signal controller Hsync and a field sync signal of the field sync signal controller Vsync. For example, the encoder is configured to encode according to a counting result of the counter, and issue a control signal for controlling the on/off states of the plurality of switches to adjust the resistance value of the variable resistor sub-circuit 100. For example, the resistance of the variable resistor sub-circuit 100 is made to be (N−n)R.

Specifically, the process of adjusting the resistance value of the R-String by the counter and the encoder is further described by taking the total row number of rows of sub-pixels N=2560 as an example.

First, for the plurality of series-connected resistors, it is necessary to select appropriate resistance values according to the row number of the row of sub-pixels to ensure that any one of 0~(N−1)R can be generated. Specifically, for N=2560, any resistance value of 0~2559R can be generated. In this case, for example, 14 series-connected resistors have the resistance values 1R, 2R, 2R, 5R, 10R, 20R, 20R, 50R, 100R, 200R, 200R, 500R, 1000R, 1000R, respectively. In practice, by controlling the on/off states of the switches connected in parallel with the resistors, any one of 0R-2559R (0, 1R, 2R, 3R, 4R, 5R, 6R, . . . , and 2559R) can be realized.

Figure 10:
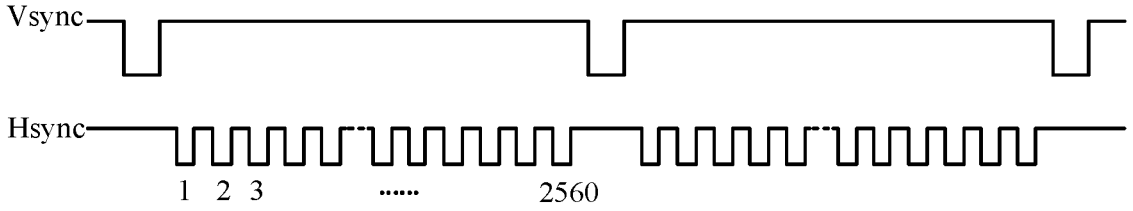
FIG. 10 is a schematic diagram of a row sync signal and a field sync signal according to an embodiment of the present disclosure.

In addition, for the counter and the encoder, referring to FIG. 10, after receiving a signal pulse of the a field sync signal Vsync, the counter starts counting the pulse signal of the row sync signal Hsync, that is, scanning a row of sub-pixels and increases the counting result by 1, and when scanning to the n-th row (any row) of sub-pixels, the counting result is n. When the counter receives the signal pulse of the field sync signal Vsync again (meaning entering the next frame-scan), the counting result is cleared, and the count of row number of the row of sub-pixels of the next frame is resumed.

For example, when the n-th row of sub-pixels is scanned, the counter outputs the counting result n to the encoder, and the encoder encodes correspondingly according to n. For example, the corresponding encoding can be performed in a corresponding manner of 2560−n (i.e., N−n). For example, the corresponding code can be obtained by querying the truth table (referring to the following table) to realize the control of the switches.

Truth Table

| Row Number n | resistance value of R-String |
|---|---|
| 1 | 2559R |
| 2 | 2558R |
| 3 | 2557R |
| . . . | . . . |
| 2559 | 1R |
| 2560 | 0R |

Specifically, for example, when the first row of sub-pixels is scanned, the counter outputs the counting result, 1, to the encoder, and the encoder encodes according to 2560−1=2559, and generates a control signal for controlling the on/off states of the switches, that is to say, the switches corresponding to the resistance values 1000R, 1000R, 500R, 50R, 5R, 2R, 2R are switched off, and the switches corresponding to other resistors are switched on, so that the resistance value of the variable resistor sub-circuit is 2559R. For example, at this time, the voltage gain of the inverting amplifying circuit 103 satisfies:

$$K_n = \frac{N-n}{N-1} = \frac{2559R}{2559R}.$$

It will be understood by those skilled in the art that when the 2560-th (the last row) row of sub-pixel is scanned, the counter outputs the counting result, 2560, to the encoder, and the encoder encodes according to 2560−2560=0. In this case, the resistance value of the variable resistor sub-circuit 100 is 0, at this time, the inverting amplifying circuit 103 is in a virtual-short state, and the output voltage of the output terminal of the inverting amplifying circuit 103 is 0, thereby securing the pixel data of the sub-pixels of the last row is directly output to each sub-pixel without compensation.

It should be noted that, in the embodiments of the present disclosure regarding the pixel data compensation device, the device corresponding to the foregoing embodiment of the pixel data compensation method is provided. However, the embodiments of the present disclosure are not limited thereto, and any modifications or adjustments or substitutions made by the compensation device according to the present disclosure will be covered by the skilled person in the art with reference to the aforementioned pixel data compensation method.

It should be noted that, in order to be clear and concise, the embodiments of the present disclosure do not give all the constituent units of the pixel data compensation device. In order to realize the necessary functions of the pixel data compensation device, those skilled in the art can provide and set other constituent units not shown according to specific needs, and the embodiments of the present disclosure are not limited in this aspect.

The embodiments of the present disclosure further provide a display device including any of the foregoing pixel data compensation devices, which have the same structure and advantageous effects as the pixel data compensation device provided by the foregoing embodiments. Because in the foregoing embodiments the structure and advantageous effects of the pixel data compensation device have been described in detail, and will not be described herein. For example, the display device can also include a source electrode drive circuit configured to provide a data signal to the pixel drive circuit. For example, the display device may further include a digital-to-analog converter 34 and a buffer 35. For example, the digital-to-analog converter 34 is configured to convert an input display data, and output the input display data that is converted to the buffer 35 for amplification to obtain initial pixel data $V_{data}$. For example, a pixel data compensation device 36 is coupled to an output terminal of the buffer 35 to compensate the initial pixel data $V_{data}$. For example, the display device may further include an interface receiver 31, a shift register 32, a row register 33, and a gamma circuit (not shown). The embodiments of the present disclosure are not limited in this aspect.

It should be noted that, in order to be clear and concise, the embodiments of the present disclosure do not give all the constituent units of the display device. In order to realize the necessary functions of the display device, those skilled in the art can provide and set other constituent units not shown according to specific needs, and the embodiments of the present disclosure do not limit this.

It should be noted that, in the embodiments of the present disclosure, the display device may specifically include at least an organic light emitting diode display panel, for example, the display panel may be applied to any display product or component such as a display, a television, a digital photo frame, a mobile phone or a tablet.

Figure 11:
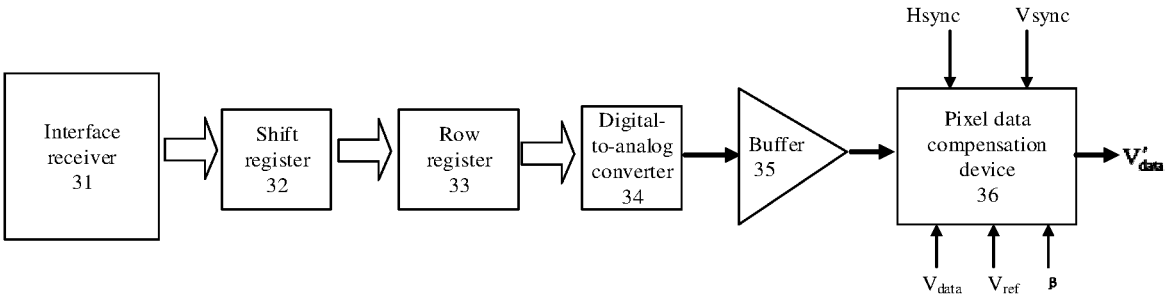
FIG. 11 is a structural schematic diagram of a source electrode driver IC according to an embodiment of the present disclosure.

In addition, it should be noted that, for the pixel data compensation device in the display device of the present disclosure, the pixel data compensation device may be an independently arranged circuit structure and coupled to an output terminal of the source electrode drive circuit (that is, source driver IC, also known as source driver IC or data driver IC, etc.); of course, in order to improve the integration degree of the entire display device, the pixel data compensation device (LCC) may be integrated inside the source electrode driver IC as shown in FIG. 11.

It should be understood by those skilled in the art that in the case of integrating a pixel data compensation device into the source electrode driver IC, for example, referring to FIG. 11, the pixel data compensation device 36 is provided, in design, at the output terminal of each output channel of the source electrode driver IC (FIG. 11 is only a schematic diagram). Specifically, the pixel data compensation device 36 may be coupled to the output terminal of the buffer in the source electrode driver IC to output the compensated pixel data to a corresponding sub-pixel point in the display panel through the source electrode driver IC.

Conventional settings in the art can be used for other settings in the source electrode driver IC, and details are not described herein.

For example, for the pixel data transmission process of the source electrode driver IC in the present disclosure, it may be as follows:

Referring to FIG. 11, for an initial pixel data stream, data can be received through an interface receiver 31 such as RSDS/Mini-LVDS/MIPI/PP, and the data are shifted by the shift register 32. When all of the data of one row are received, all of the data of one row is saved in row registers 33, and the amount of row registers 33 corresponds to that of the output ports of the source electrode driver IC. Then, a digital signal is converted to a voltage signal by the digital-to-analog converters 34, amplified by the buffer 35, and compensated by the pixel data compensation device 36, then output by an output port of the source electrode driver IC to a data line of the display panel.

The embodiments of the invention are thus described, and it will be obvious that the same may be varied in many ways. Such variations are not to be regarded as a departure from the spirit and scope of the invention, and all such modifications as would be obvious to those skilled in the art are intended to be included within the scope of the following claims.

What is claimed is:

1. A pixel data compensation method for a display device, the display device comprising N rows of sub-pixels, the pixel data compensation method comprising:

obtaining, for a sub-pixel of an n-th row in a column, a pixel compensation quantity Q of the sub-pixel according to a row compensation coefficient $K_n$ of the n-th row of sub-pixels and a voltage deviation $\Delta V_{data}$ corresponding to an initial pixel data $V_{data}$ of the sub-pixel; and compensating the initial pixel data $V_{data}$ of the sub-pixel according to the pixel compensation quantity Q of the sub-pixel to obtain a compensated pixel data $V'_{data}$ of the sub-pixel, wherein the row compensation coefficient $K_n$ decreases as a row number of the row in which the sub-pixel is located increases, and $0 \le K_n \le 1$, $1 \le n \le N$, and $1 \le N$.

2. The pixel data compensation method according to claim 1, wherein the voltage deviation $\Delta V_{data}$ corresponding to the initial pixel data $V_{data}$ of the sub-pixel is a voltage difference between a voltage of a gate electrode of a driving transistor of a sub-pixel of a first row and a voltage of a gate electrode of a driving transistor of a sub-pixel of a last row in a case where each row of sub-pixels is driven row by row using the initial pixel data $V_{data}$.

3. The pixel data compensation method according to claim 1, wherein the row compensation coefficient of the n-th row of sub-pixels is:

$$K_n = \frac{N-n}{N-1} \text{ or } K_n = \frac{N-n}{N}.$$

4. The pixel data compensation method according to claim 1, wherein the voltage deviation $\Delta V_{data}$ corresponding to the initial pixel data $V_{data}$ of the sub-pixel and the initial pixel data $V_{data}$ of the sub-pixel satisfy a first relation:

$$\Delta V_{data} = \alpha(V_{data} - V_{ref}) + \beta,$$

where $\alpha$, $\beta$ are compensation coefficients and are constants for the display device; and $V_{ref}$ is a charging reference voltage of a storage capacitor for compensating a threshold voltage of the driving transistor in the sub-pixel.

5. The pixel data compensation method according to claim 1, wherein the pixel compensation quantity Q of the sub-pixel, the row compensation coefficient $K_n$ of the n-th row of sub-pixels and the voltage deviation $\Delta V_{data}$ corresponding to the initial pixel data $V_{data}$ of the sub-pixel satisfy a second relation:

$$Q = K_n - \Delta V_{data}.$$

6. The pixel data compensation method according to claim 1, wherein the compensated pixel data $V'_{data}$ of the sub-pixel, the initial pixel data $V_{data}$ of the sub-pixel, and the pixel compensation quantity Q of the sub-pixel satisfy a third relation:

$$V'_{data} = V_{data} - Q.$$

7. The pixel data compensation method according to claim 1, wherein the display device further comprises a digital-to-analog converter and a buffer, an input display data is converted by the digital-to-analog converter and a converted input display data is amplified by the buffer to obtain the initial pixel data $V_{data}$.

8. A pixel data compensation device for a display device, the display device comprising N rows of sub-pixels, the pixel data compensation device comprising:

a pixel compensation quantity operation circuit, which is configured to obtain, for a sub-pixel of an n-th row in a column, a pixel compensation quantity Q of the sub-pixel according to a row compensation coefficient $K_n$ of the n-th row of sub-pixels and a voltage deviation $\Delta V_{data}$ corresponding to an initial pixel data $V_{data}$ of the sub-pixel; and a compensation pixel data operation circuit, which is configured to compensate the initial pixel data $V_{data}$ of the sub-pixel according to the pixel compensation quantity Q of the sub-pixel to obtain a compensated pixel data $V'_{data}$ of the sub-pixel, wherein the row compensation coefficient $K_n$ decreases as a row number of the row in which the sub-pixel is located increases, and $0 \le K_n \le 1$, $1 \le n \le N$, and $1 \le N$.

9. The pixel data compensation device according to claim 8, wherein the voltage deviation $\Delta V_{data}$ corresponding to the initial pixel data $V_{data}$ of the sub-pixel is a voltage difference between a voltage of a gate electrode of a driving transistor of a sub-pixel of a first row and a voltage of a gate electrode of a driving transistor of a sub-pixel of a last row in the case where each row of sub-pixels is driven row by row using the initial pixel data $V_{data}$.

10. The pixel data compensation device according to claim 8, wherein the pixel compensation quantity operation circuit comprises: a first sub-operation circuit, a second sub-operation circuit and a third sub-operation circuit, wherein a first input terminal of the first sub-operation circuit is coupled to a reference voltage terminal to receive the reference voltage $V_{ref}$, a second input terminal of the first sub-operation circuit is coupled to an initial pixel data input terminal to receive the initial pixel data $V_{data}$, and an output terminal of the first sub-operation circuit is coupled to a first input terminal of the second sub-operation circuit;

a second input terminal of the second sub-operation circuit is coupled to a first voltage terminal to receive a first voltage, and an output terminal of the second sub-operation circuit is coupled to a first input terminal of the third sub-operation circuit; and an output terminal of the third sub-operation circuit is coupled to the compensation pixel data operation circuit, and the third sub-operation circuit is configured to invert the pixel compensation quantity of the sub-pixel that is obtained to generate an inverted pixel compensation quantity and output the inverted pixel compensation quantity to the compensation pixel data operation circuit.

11. The pixel data compensation device according to claim 10, wherein a voltage gain of the first sub-operation circuit is equal to $\alpha$;

a first voltage of the first voltage terminal is $\beta$, a voltage gain of the second sub-operation circuit is equal to 1; and a voltage gain of the third sub-operation circuit is equal to the row compensation coefficient $K_n$.

12. The pixel data compensation device according to claim 10, wherein the compensation pixel data operation circuit comprises a fourth sub-operation circuit and a fifth sub-operation circuit;

wherein a first input terminal of the fourth sub-operation circuit is coupled to the output terminal of the third sub-operation circuit to receive the inverted pixel compensation quantity of the sub-pixel, a second input terminal of the fourth sub-operation circuit is coupled to the initial pixel data input terminal for the sub-pixel to receive the initial pixel data $V_{data}$, and an output terminal of the fourth sub-operation circuit is coupled to an input terminal of the fifth sub-operation circuit, and fifth sub-operation circuit is configured to obtain the compensated pixel data $V'_{data}$ of the sub-pixel after inverting by the fifth sub-operation circuit.

13. The pixel data compensation device according to claim 10, wherein the first sub-operation circuit comprises a first difference circuit, the second sub-operation circuit comprises a second difference circuit, the third sub-operation circuit comprises an inverting amplifying circuit, the fourth sub-operation circuit comprises a summing circuit, and the fifth sub-operation circuit comprises an inverting circuit.

14. The pixel data compensation device according to claim 10, wherein the third sub-operation circuit comprises an operational amplifier, a first resistor and a variable resistor sub-circuit, an inverting terminal of the operational amplifier is coupled to the first input terminal of the third sub-operation circuit through the first resistor, and the variable resistor sub-circuit is connected between an output of the operational amplifier and the inverting terminal.

15. The pixel data compensation device according to claim 14, wherein the variable resistor sub-circuit comprises a plurality of series-connected base resistors and a plurality of switches connected in parallel with the base resistors, and is configured to obtain a desired resistance value by selecting on/off states of the switches connected in parallel with the corresponding base resistor.

16. The pixel data compensation device according to claim 15, wherein the variable resistor sub-circuit further comprises a counter and an encoder, wherein the counter is coupled to a row sync signal controller and a field sync signal controller, and is configured to count a row number n of a currently-switched-on row of sub-pixels according to a row sync signal of the row sync signal controller and a field sync signal of the field sync signal controller; and the encoder is coupled to the plurality of switches connected in parallel with the base resistors and the counter, and is configured to encode according to a counting result of the counter, and issue a control signal for controlling the on/off states of the plurality of switches to adjust the resistance value of the variable resistor sub-circuit.

17. The pixel data compensation device according to claim 16, wherein a resistance value of the variable resistor sub-circuit is (N−n)R, and a resistance value of the first resistor is (N−1)R.

18. A display device, comprising the pixel data compensation device according to claim 8.

19. The display device of claim 18, further comprising a source electrode driver circuit, wherein the source electrode driver circuit comprises the pixel data compensation device.

20. A display device according to claim 18, further comprising a digital-to-analog converter and a buffer, wherein the digital-to-analog converter is configured to convert an input display data, and output the input display data that is converted to the buffer for amplification to obtain the initial pixel data $V_{data}$; and the pixel data compensation device is coupled to an output terminal of the buffer to compensate the initial pixel data $V_{data}$.

* * * * *